US007259647B2

(12) United States Patent
Gilmore

(10) Patent No.: US 7,259,647 B2
(45) Date of Patent: Aug. 21, 2007

(54) METHOD OF USING REED SWITCH APPARATUS TO CONTROL ONE OR MORE DEVICES

(76) Inventor: Glendell N. Gilmore, P.O. Box 690851, Houston, TX (US) 77269

( * ) Notice: Subject to any disclaimer, the term of this patent is extended or adjusted under 35 U.S.C. 154(b) by 0 days.

(21) Appl. No.: 11/280,006

(22) Filed: Nov. 16, 2005

(65) Prior Publication Data

US 2006/0077024 A1 Apr. 13, 2006

Related U.S. Application Data

(63) Continuation of application No. 10/369,004, filed on Feb. 19, 2003, now Pat. No. 6,977,570.

(51) Int. Cl.
*H01H 9/00* (2006.01)

(52) U.S. Cl. ..... 335/205; 340/547

(58) Field of Classification Search ..... 340/547; 335/205–207

See application file for complete search history.

(56) References Cited

U.S. PATENT DOCUMENTS

| | | | |
|---|---|---|---|
| 3,544,934 | A | 12/1970 | Poliakoff |
| 4,170,005 | A | 10/1979 | Duke |
| 4,210,889 | A | 7/1980 | Holce |
| 4,258,346 | A | 3/1981 | Williams |
| 4,319,712 | A | 3/1982 | Bar |
| 4,409,577 | A | 10/1983 | Holce et al. |
| 4,465,997 | A | 8/1984 | Hines |
| 4,988,965 | A | 1/1991 | Borja |
| 5,243,325 | A | 9/1993 | Marin et al. |
| 5,559,482 | A | 9/1996 | Close et al. |
| 5,576,678 | A | 11/1996 | Saunders |
| 5,589,811 | A | 12/1996 | Pariot et al. |
| 5,633,626 | A | 5/1997 | Cawthorne |
| 5,668,533 | A | 9/1997 | Jackson, Jr. et al. |
| 5,713,621 | A | 2/1998 | Krenkel et al. |
| 5,723,835 | A | 3/1998 | Gilmore |
| 5,754,107 | A | 5/1998 | Ferrantelli |
| 5,777,552 | A | 7/1998 | Fischette et al. |
| 5,877,664 | A | 3/1999 | Jackson, Jr. |
| 6,011,469 | A | 1/2000 | Taft et al. |
| 6,019,156 | A * | 2/2000 | Wagner et al. ..... 160/310 |
| 6,225,903 | B1 | 5/2001 | Soloway et al. |

(Continued)

OTHER PUBLICATIONS

Introduction to the Digital Sensor, http://www.crime-prevention-products.com/closet.htm, printed May 14, 2003, 1 page, date of first publication unknown.

Electric Door Light Switch, http://www.smarthome.com/5188.html, printed May 14, 2003, 1 page, date of first publication unknown.

(Continued)

*Primary Examiner*—Elvin Enad
*Assistant Examiner*—Bernard Rojas
(74) *Attorney, Agent, or Firm*—Douglas W. Rommelmann; Andrews Kurth LLP

(57) ABSTRACT

A reed switch apparatus utilizes one or more reed switches to communicate with one or more devices. In one configuration, the reed switch apparatus utilizes a single magnetic field to simultaneously activate two or more reed switches. In another configuration, two or more reed switches, each acting independent of one another are simultaneously activated by a single magnetic field. Additionally, a method of controlling at least two devices includes exposing a reed switch apparatus to a single magnetic field. Yet another method includes a activating a device via the use of a single reed switch mounted to a portion of a warehouse structure.

32 Claims, 7 Drawing Sheets

U.S. PATENT DOCUMENTS

| | | | |
|---|---|---|---|
| 6,249,224 | B1 | 6/2001 | Shoen et al. |
| 6,310,548 | B1 | 10/2001 | Stephens et al. |
| 6,348,861 | B1 | 2/2002 | Li |
| 6,359,538 | B1 | 3/2002 | Jolley et al. |
| 6,400,267 | B1 | 6/2002 | Gordon-Levitt et al. |

OTHER PUBLICATIONS

Closet light and other night lights and other parts in electrical at AubuchonHardware.com, http://electrical.aubuchonhardware.com/wiring_and_boxes/night_lights_and_other_parts/closet_light-514233.asp, printed May 14, 2003, 1 page, date of first publication unknown.

Learn how to install and electric switch at AubuchonHardware.com by AubuchonHardware, http://electrical.aubuchonhardware.com/do_it_yourself_projects/how_to_install_an_electric_switch.asp, printed May 14, 2003, 8 pages, date of first publication unknown.

Quick Switch—p. 13, printed May 16, 2003, 1 page, date of first publication unknown.

Door Alarm Detail, Roll-Up Door Contact, ftp://216.89.18.228/web/draw/Roll_Up_Door_Contact_-.01.pdf, printed May 16, 2003, 1 page, date of first publication Feb. 24, 1998.

* cited by examiner

FIG. 7
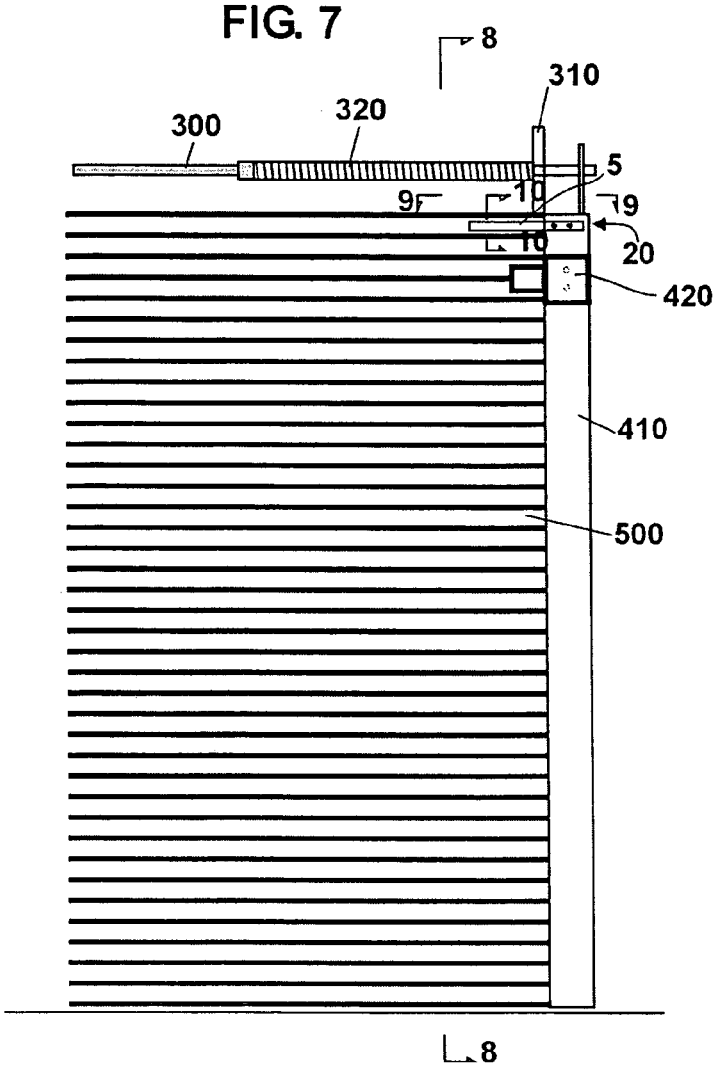
FIG. 8
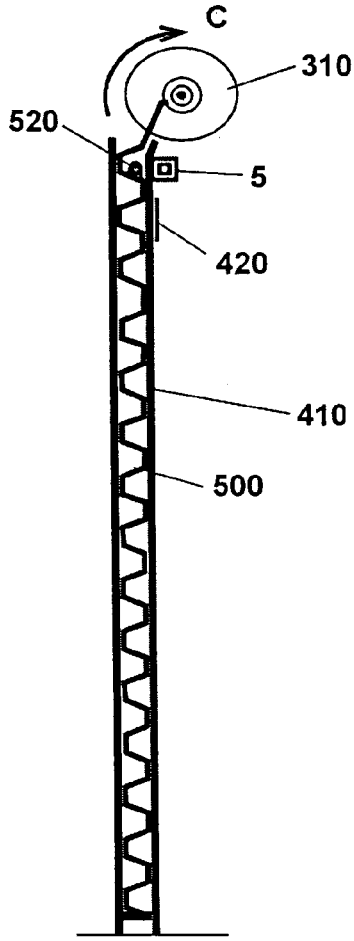
FIG. 9
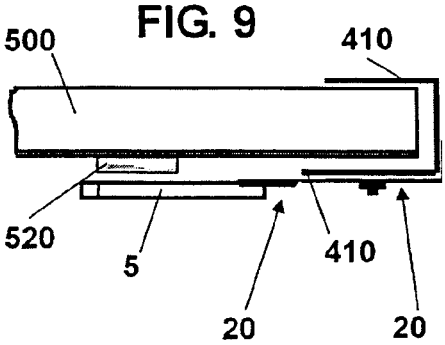
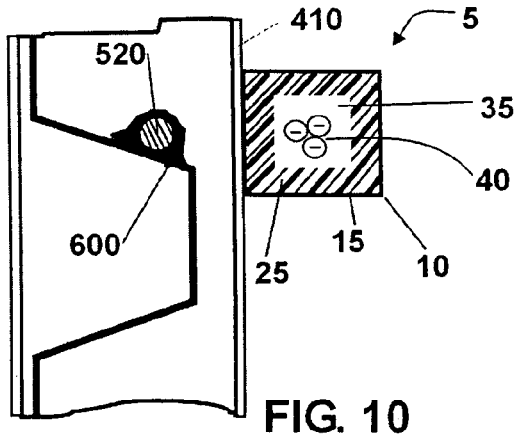
FIG. 10

FIG. 13
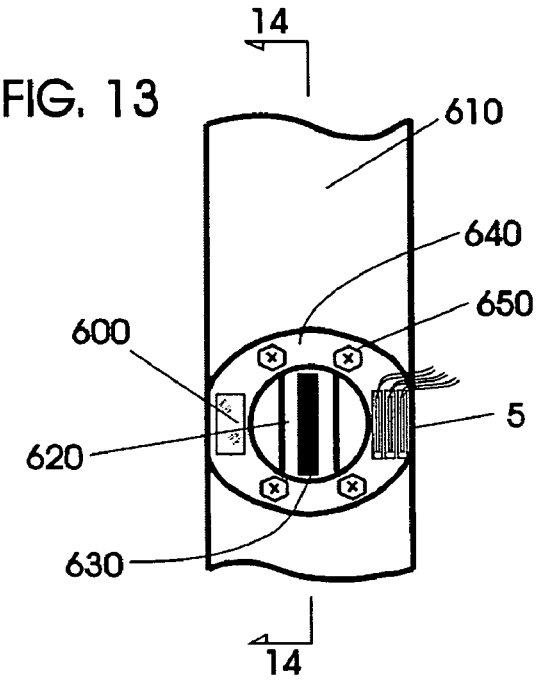
FIG. 13A
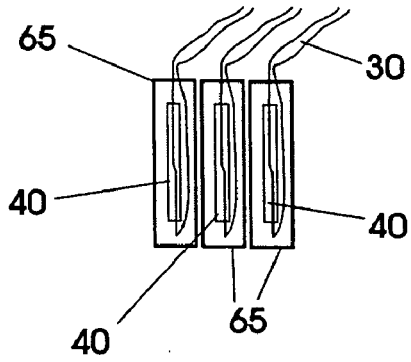
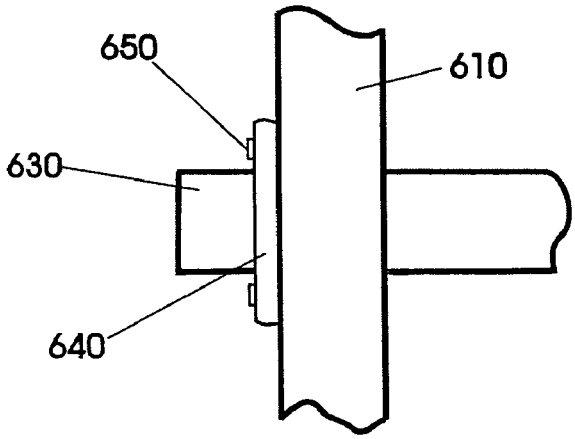
FIG. 14

METHOD OF USING REED SWITCH APPARATUS TO CONTROL ONE OR MORE DEVICES

CROSS-REFERENCE TO RELATED APPLICATIONS

This application is a continuation of U.S. patent application Ser. No. 10/369,004, filed Feb. 19, 2003 now U.S. Pat. No. 6,977,570.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates generally to reed switches and more specifically to the method of using one or more reed switches to control one or more devices.

2. Description of the Related Art

Reed switches are magnetically-operated switches, which are generally formed by a pair of spaced ferromagnetic contacts or blades, hermetically sealed in a glass capsule. In a typical application and use of a reed switch, the blades are connected to outside leads—each outside lead being part of a circuit. The exposure of the blades to a magnetic field—coming from either a permanent magnetic or electromagnetic generation—forces the blades to move, either contacting one another or moving away from one another. In what is known as a normally closed reed switch ("Normal" in this sense and as will be used herein means a state where the reed switch is exposed to a magnetic field), the blades touch when exposed to a magnetic field. By removing the magnetic field, the normally closed reed switch opens and the contacts will no longer touch. Contrariwise, in a normally open reed switch, the contacts touch in the absence of a magnet. By exposing the normally open reed switch to the magnetic field, the contacts move apart and the circuit is opened. After the magnetic field has been removed from these reed switches, the blades will return to their original position.

Generally, the reed switch is activated (that is, causing the ferromagnetic blade to move, be it closing the circuit or opening the circuit) via the use of a magnetic field. Such an activation allows communication to be established with a system or device. In some instances the communication may be the lack of a signal or electrical energy being returned when the switch opens the circuit, while in other instances, the communication may be the circuit being completed. One recognized use of a reed switch is monitoring the "change of state" of something in security systems. For example, a reed switch can cause a circuit to be completed or broken when a window or door opens or closes. This change of condition (opening or closing of the circuit) can automatically be detected by a central alarm system or the like, indicating whether or not an unauthorized "change of state" has occurred. A typical security use of such a reed switch may be, for example, on a window or door of a house or on a roll-up door of a storage shed. In such situations, it is well known and understood that the central alarm system receives a low voltage signal passing through the reed switch to indicate one status of the door or window, and does not receive the low voltage signal from the open reed switch when the door or window is in another state.

With the use of reed switches to control a device, several design considerations must be taken into account. Reed switches are by their very nature fragile—that is, the glass capsules can break. An exacerbation of the fragile nature is the likelihood that two reed switches in too close proximity to one another may hit and break each other.

SUMMARY OF THE INVENTION

The present invention includes a method of controlling a high voltage device via the use of a single reed switch mounted, for example, to a portion of a warehouse structure. Yet another embodiment of the invention includes a method of controlling a plurality of devices with a reed switch apparatus having a plurality of reed switches. When the reed switch apparatus is exposed to a single magnetic field, the plurality of reed switches are activated. The activation of the plurality of reed switches facilitates the communication with each of the plurality of devices.

The present invention includes in one embodiment a reed switch apparatus having a plurality of reed switches which communicate with a plurality of devices. In one configuration, the reed switch apparatus has been arranged and designed such that a single magnetic field can simultaneously activate all of the plurality of reed switches. In another configuration, two or more reed switches, each acting independent of one another are simultaneously activated by a single magnetic field.

BRIEF DESCRIPTION OF THE SEVERAL VIEWS OF THE DRAWINGS

A better understanding of the present invention can be obtained when the following detailed description of the disclosed embodiments is considered in conjunction with the following drawings, in which:

FIG. 7 shows another embodiment of the reed switch apparatus, illustrating one use of the reed switch apparatus;

FIG. 8 shows a cross sectional view cut across lines 8-8 of FIG. 7;

FIG. 9 shows a cross sectional view cut across lines 9-9 of FIG. 7;

FIG. 10 shows a cross sectional view cut across lines 10-10 of FIG. 7;

FIGS. 13 and 13A show another embodiment of the reed switch apparatus, having multiple housings; and FIG. 14 shows a cross sectional view cut across lines 14-14 of FIG. 13.

DETAILED DESCRIPTION OF THE INVENTION

Figure 2:
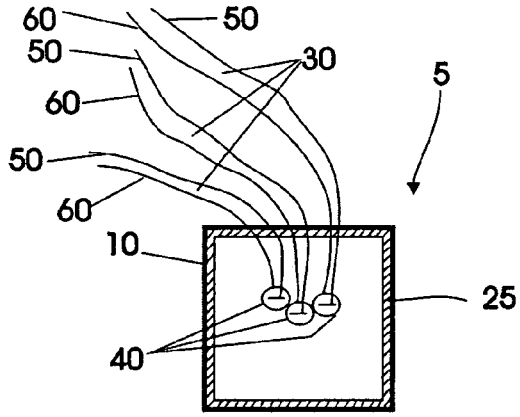
FIG. 2 shows a cross sectional view of the reed switch apparatus, cut across lines 2-2 of FIG. 1.
Figure 1:
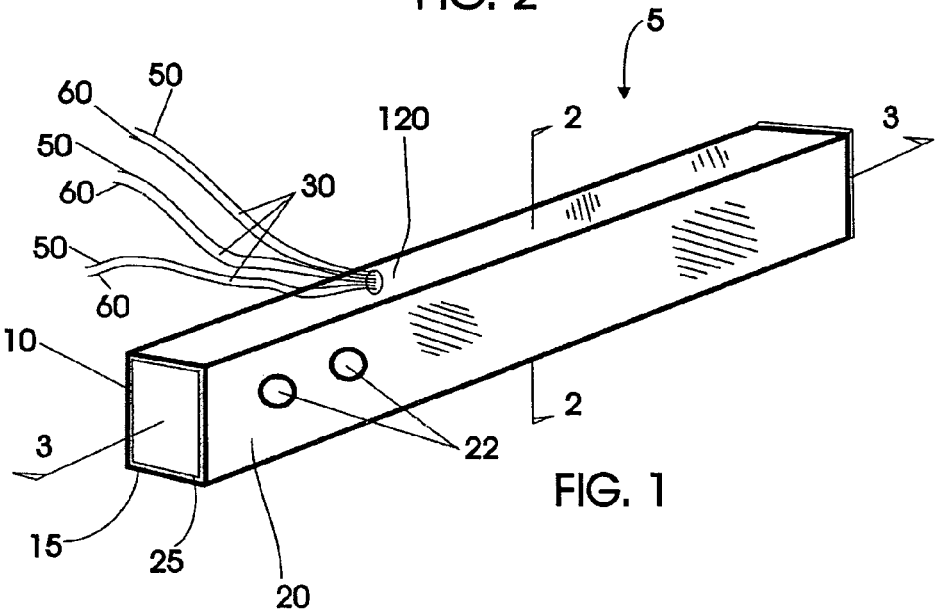
FIG. 1 shows an embodiment of the reed switch apparatus in an isolated view.
Figure 3:
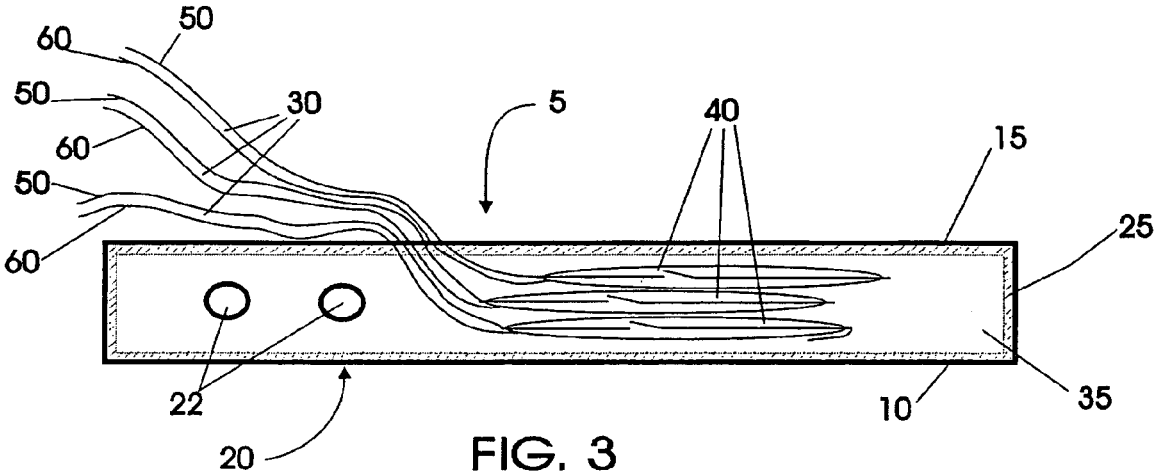
FIG. 3 shows a cross sectional view of the reed switch apparatus, cut across lines 3-3 of FIG.1.

Several different embodiments, not drawn to scale, are shown in FIGS. 1-14, illustrating several concepts of the invention. FIGS. 1-3, in several views show a first embodiment of a reed switch apparatus 5. The reed switch apparatus 5 in this embodiment includes a reed switch housing 10, a plurality of reed switches 40 (FIG. 3) and an attachment device 20. The reed switch housing 10 includes an outer body 15, which is arranged and designed as an outermost protective coating for the reed switches 40. The choice of material for outer body 15 can vary with design and intended use, but preferably the material is of such a nature that it is non-magnetic—or, will not interfere with the magnetic action of reed switches—and is strong and rigid enough to maintain its position when mounted to a specific object, e.g., a door or window. Suitable material for outer body 15 would include aluminum and plastic. The outer body 15 of the reed switch housing 10 can be of such a nature that it will absorb much of the impact caused by shock and forces that may be imparted to the reed switch housing 10 and ultimately the reed switches 40. Such shock and forces are undesirable as they can cause the glass capsules of reed switches 40 to break. While every embodiment may not need additional protective measures, the preferred embodiment includes a buffer to protect the reed switches 40. One such buffer is described in U.S. Pat. No. 5,723,835, issued to Gilmore, which is owned by the applicant of the current application and is herein incorporated in its entirety. Part of the buffer in this embodiment includes resilient material 25, which can be made of any material known for its ability to absorb mechanical energy, namely poly-foam, polystyrene, silicone, polymers and the like. This resilient material 25 fits just inside the outer body 15, preferably fitting flush therewith. In some embodiments, the resilient material 25 can fill the entire reed switch housing 10. In this embodiment, as is preferably the design, the buffer also includes a gas blend 35 placed inside the resilient material 25, which fluidly isolates the reed switches 40. The gas blend 35 suspends the reed switches 40 to help the reed switches 40 from coming in contact with the outer body 15, and also from coming in contact with one another. One such gas blend is an ammonia methanol by-product produced from curing of silicone, when silicone is used as the resilient material 25.

While not shown in the embodiment of FIGS. 1-3, in other embodiments the buffering of the reed switches 40 can include a material, which can absorb mechanical energy, placed on the outside of the reed switches 40. Such materials can include shrink-wrapped plastic, a rubber coating, or the like.

While the reed switch housing 10 shown in FIGS. 1-3 has been shown with reference to one central compartment or cavity that houses all the reed switches 40, other embodiments may include a reed switch apparatus 5 which utilize several compartments or housings. One such example is described below with reference to FIG. 13A. The dynamics, intended use, and materials ultimately used will to a certain degree dictate the type of structure which can be used for the reed switch device 5 and corresponding housing for the reed switches 40.

Referring to FIG. 2, extending from the reed switch housing 10 at opening 120 (FIG. 1) are leads 30, attached to the reed switches 40. In this embodiment, a pair of leads 30 correspond to each reed switch 40. Each pair of leads 30 includes a common 50 and a switch control signal 60. As shown in FIGS. 2 and 3, the reed switches 40 are in such proximity to one another that a single magnetic field (not shown) can activate all the reed switches 40. The activation of one of the reed switches 40 can include, as briefly described in the background, the closing of a normally closed switch or the opening of a normally open switch. Once again, "normal" in this sense means a state where the reed switch 40 is exposed to a magnetic field (for example, a magnet being within close proximity to the reed switch). While three reed switches 40 are shown, two or more can be used in practice. Additionally, the reed switches 40 can include a combination of switches—including, but not limited to, those described above with reference to this embodiment.

Also shown in this embodiment is attachment device 20. In this embodiment, attachment device 20 comprises a mounting hole 22, which facilitates the installation of the reed switch apparatus 5. Other attachment devices 20, which should become apparent to those skilled in the art, can be used—some of which are described in the embodiments below.

In practice, the reed switch apparatus 5 can be placed in a selective location. Upon exposure of the reed switches 40 inside reed switch apparatus 5 to a magnetic field (not shown), the reed switches 40 are forced or activated (opening or closing—depending on the type of reed switch 40 being used), into the normal state. In this embodiment, each of the reed switches 40 can complete or open a circuit, via leads 30 through a common 50 and a switch control signal 60, communicating with one of the many devices used in various industries. This communication from reed switches 40, while not shown in this embodiment can be routed to a hardwired device, sent to a control module, or sent to a device which is in wireless communication with one of the leads 30.

Figure 4:
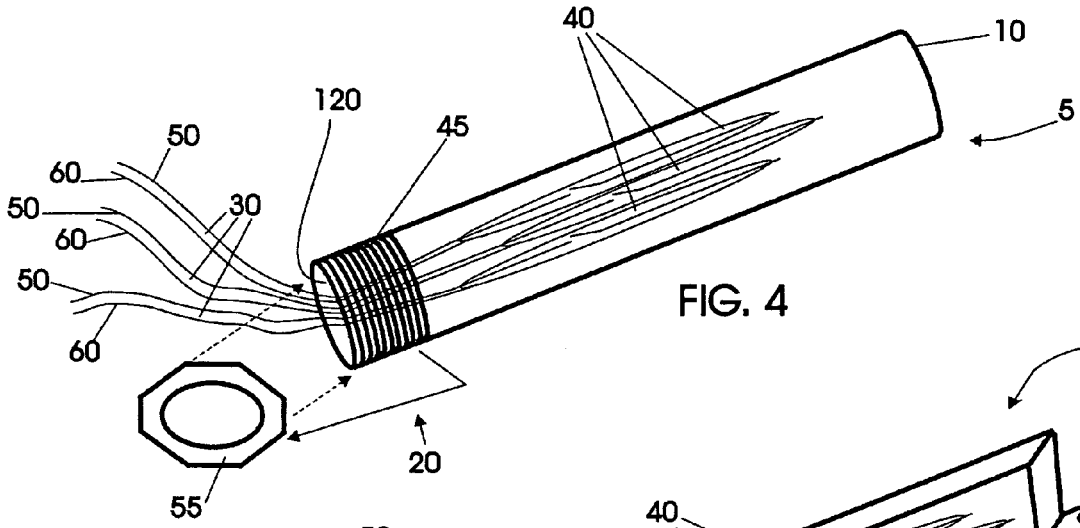
FIG. 4 shows another embodiment of the reed switch apparatus with a threaded round switch housing.
Figure 6:
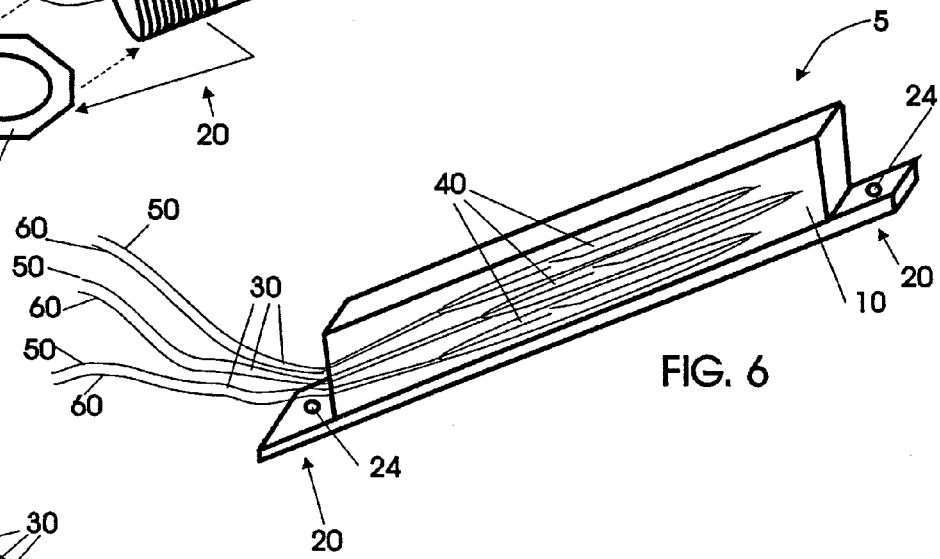
FIG. 6 shows another embodiment of the reed switch apparatus with a housing arranged and designed to fit on a door or window.
Figure 5:
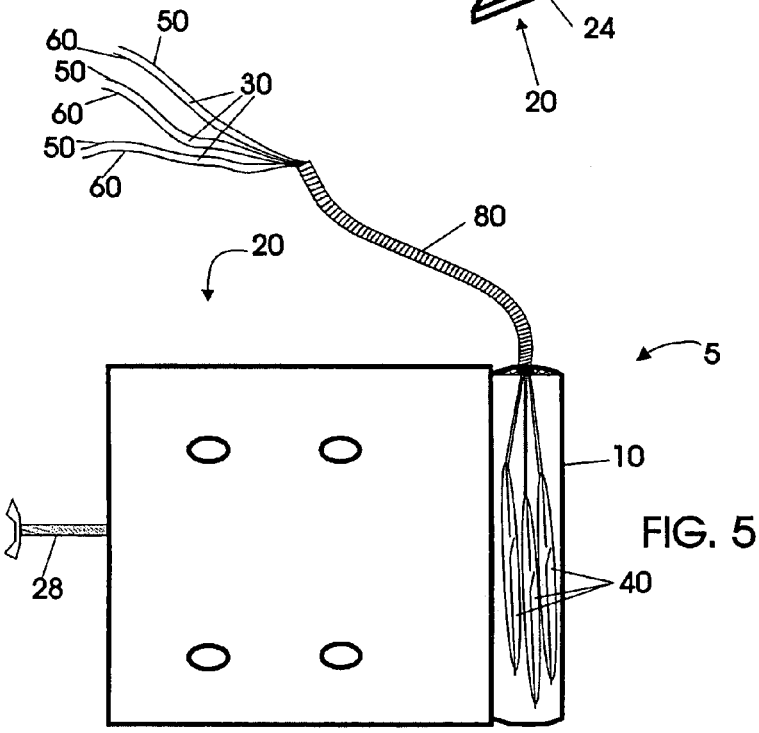
FIG. 5 shows another embodiment of the reed switch apparatus with a housing arranged and designed to be placed on a door track.

FIGS. 4, 5 and 6 each show an alternative embodiment of reed switch apparatus 5. In all three embodiments, the reed switch apparatus 5 operates with a similar concept to that described in FIGS. 1-3, with slight differences. In FIG. 4, the reed switch housing 10 is a threaded, round switch housing and three reed switches 40 are being used. The use of a tubular design will allow unique structural advantages over other designs as will be appreciated by one of ordinary skill in the art of structural dynamics. Additionally, the tubular design will allow insertion of the reed switch apparatus 5 in a structure designed to receive round structures—e.g., in the door drum of a roll up door. Shown in phantom view are three reed switches 40 with three sets of leads 30 (also, partially shown in phantom view), connected thereto. The three sets of leads 30 extend out through an opening 120 in the end of the reed switch housing 10. At the end of the reed switch housing 10 and adjacent to opening 120 is the attachment device 20, which in this embodiment includes threading 45 corresponding to a nut 55. While three reed switches 40 have been shown in this embodiment, more can be used in practice.

In FIG. 5, the reed switch housing 10 is arranged and designed to fit on a track of a roll-up door. Shown in phantom view are the three reed switches 40 with three sets of leads 30, connected thereto. In this embodiment, the three sets of leads 30 are fed into an armored cable housing 80 upon exiting the reed switch housing 10. The armored cable housing 80 protects leads 30 outside of the reed switch housing 10. The attachment device 20 in this embodiment includes attachment via a wing nut 28.

In FIG. 6, the reed switch housing 10 is arranged and designed to fit on a door or window. Shown in phantom view are three reed switches 40, which connect to the three sets of leads 30. The three sets of leads 30 extend out through an opening 120 (not shown in this view) in the reed switch housing 10. The attachment device 20 in this embodiment includes attachment holes 24—which allow mounting via the use of nails, screws or pop rivets.

Figure 6A:
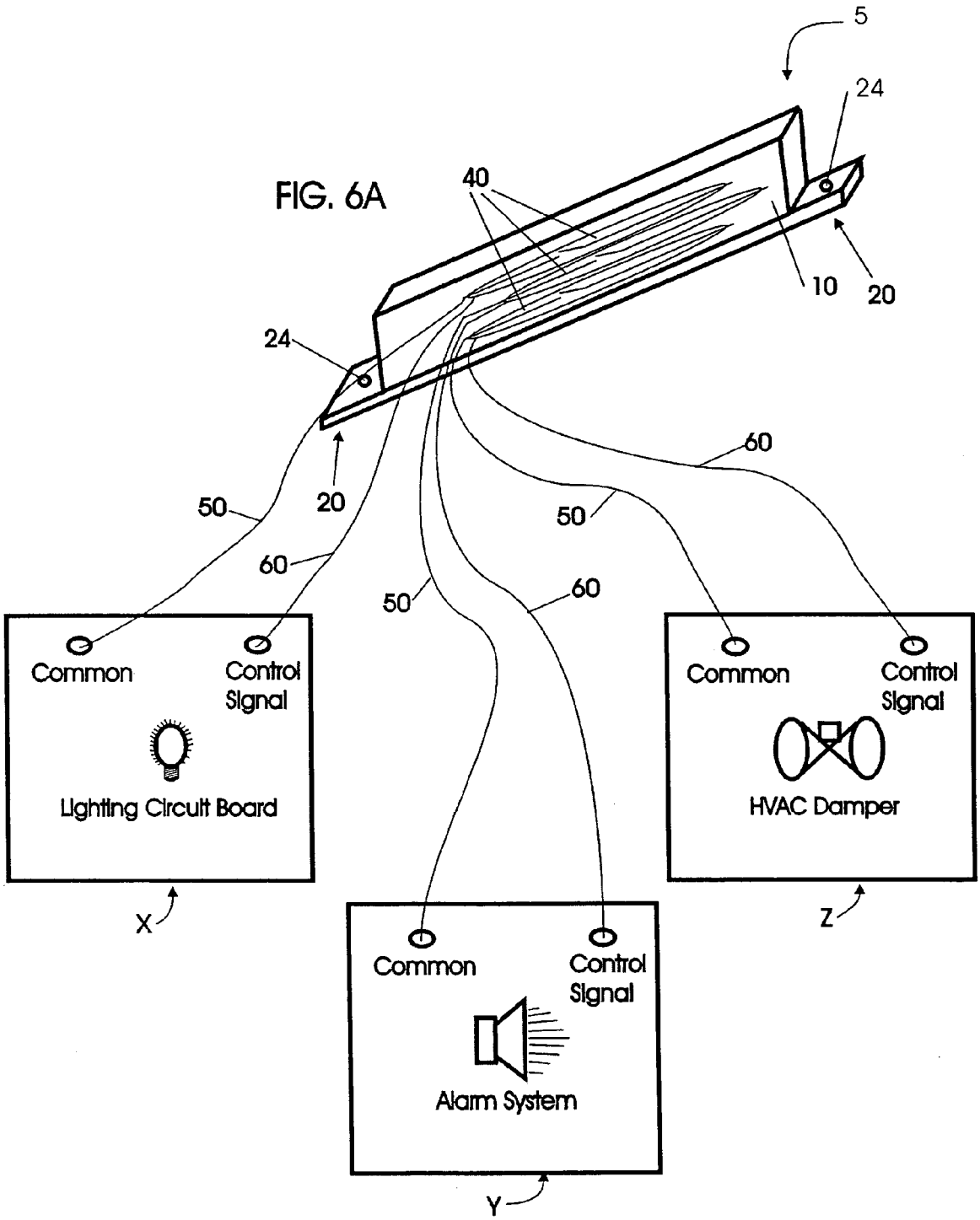
FIG. 6A shows an illustrative embodiment of a use of the reed switch apparatus of FIG. 6 in the control of multiple devices.

FIG. 6A is an illustrative embodiment of a use of the reed switch apparatus 5 shown in FIG. 6 to control multiple systems or devices. In this illustrative embodiment, each of the three reed switches 40 in the reed switch apparatus 5 interfaces or communicates with a separate system or device. Each device or system in this embodiment is independent of the other device(s) or system(s), utilizing its own reed switch 40 with corresponding control signal lead 60 and corresponding common lead 50 to be able to operate properly. In other words, the devices or systems do not use a common reed switch. In other embodiments, to the extent foreseeable by one of ordinary skill in the art, each of the reed switches 40 in reed switch apparatus 5 can communicate a signal, which ultimately controls several devices. The systems or devices have been indicated in this embodiment as a lighting circuit board X, alarm system Y. and HVAC damper Z. In this interface, an electrical signal can be sent through switch control lead 60. When the device's corresponding reed switch 40 is closed (for example, when the magnet is present), the electrical signal will be relayed back through the common lead 50, indicating to that device or system that its circuit is closed. All three reed switches 40 in this embodiment are normally closed. As such, the signals from the switch control leads 60 are not relayed back through the common leads 50 when not exposed to the magnetic field. When the reed switch apparatus 5 is exposed to the magnetic field (for example, by placing a magnet within close proximity to the reed switch apparatus 5), the reed switches 40 move to the closed position and the communicative signal is relayed back to each respective device or system —e.g., the circuit is closed. When the reed switch apparatus 5 is not exposed to a magnetic field (for example, removing a magnet from close proximity to the reed switch apparatus 5), the reed switches 40 move to the open position and the communicative signal is no longer relayed back to each respective device or system—e.g., the circuit is open. In this regard, it should become apparent to one of ordinary skill in the art that each device or system (e.g., X, Y or Z) can determine what actions to take upon either receiving a signal or not receiving a return signal. For example, the alarm system can activate upon the lack of a signal being returned.

As another example, intended for illustrative purposes only, the reed switch apparatus 5 can include two reed switches 40—one that is normally open and one that is normally closed (not shown). The reed switch apparatus 5 can be placed on a window near a magnet, such that when the window is closed, the magnetic field causes both reed switches 40 to be in the activated or normal state. In this illustration, the normally open reed switch 40 can interface or communicate with an internal siren and the normally closed reed switch 40 can communicate with a security system. With both reed switches 40 being activated, the security system in communication with the normally closed reed switch 40 receives an electrical signal, while the internal siren in communication with the normally open reed switch 40 does not receive an electrical signal. When the window is open, the magnetic field is removed from the reed switches 40 and returns the reed switches 40 to their non-normal state—in this case, the switch to the internal siren being closed and the switch to the security system being opened. The security system, in not receiving a return signal because of the open circuit, recognizes that the window is open and the siren, in receiving the electrical signal because the circuit is closed, initiates.

While several structures have been shown with reference to the embodiments of FIG. 1-6, the actual dynamics and physical features of the reed switch housing 10 will depend on the desired use.

In operation, the embodiments of the reed switch apparatus 5 described with reference to FIGS. 1-6 can be used in many applications to control a multiplicity of devices when exposed to a single magnetic field. In this regard, the reed switch apparatus 5 can utilize several reed switches 40, each of the reed switches 40 being either normally opened or normally closed. As the reed switches 40 are closely packed or sandwiched in close proximity to one another, they can all be activated at the same time with a single magnetic field. The magnetic field, as will be commonly recognized by one of ordinary skill in the art, can be created by either a permanent magnet or one generated through an electromechanically activated coil. Utilizing several of these reed switches 40 in reed switch apparatus 5 allows communication to be established with several devices at the same instance, but independent of one another. In other words, each of the reed switches 40 in reed switch apparatus 5 need not utilize a common circuit; each of the reed switches 40 can have its own circuit As mentioned herein, in some embodiments the reed switches 40 in the reed switch apparatus 5 can communicate with several devices. With these embodiments, as well as others described herein, the channels of communication can be in many forms. In simpler embodiments, a direct hard wired communication channel is used where the communicative signal is sent or received directly from the leads 30 of the reed switch apparatus 5. In other embodiments, the communicative signal can be sent across a wireless connection. As one example, the wireless communication can be digital, being based upon the Institute of Electrical and Electronics Engineers 802.12 wireless standard (IEEE 802.12, 1998 Edition (ISO/IEC 8802-12:1998)) or those based upon the Bluetooth wireless standard. Other wireless communications include infrared, radio signals, and the like. In other embodiments, the channels of communication can include various combinations.

FIGS. 7-10 show in an illustrative view one use of the reed switch apparatus 5. This illustration is intended to only be explanatory thereof and is not intended to preclude other uses, which are available to the extent foreseeable by one of ordinary skill in the art. Generally shown in FIG. 7 is a door 500 of the roll-up type, which is flexible enough to move from a vertically closed position to its rolled-up position at the top of the guide track 410. As shown in FIG. 8, the door 500 is corrugated permitting it to coil up on a rotatable support rod 300. A disc 310 is mounted on each end of the rotatable support rod 300 for retaining each end of the door 500 as it is wound up. Items typically used in such roll-up doors are also shown, including a door stop 420, which prevents the door 500 from further rotation around support rod 300 when a door plate (not shown) on the bottom of the door 500 comes in contact therewith.

The reed switch apparatus 5, as mentioned above, can be mounted in several places—dependent on use. In FIG. 7, the reed switch apparatus 5 is shown mounted via attachment device 20 to track 410 on a roll-up door 500. A single reed switch apparatus 5 with multiple reed switches 40 such as this can interface with multiple systems. Such a multiple system interface is discussed below with reference to FIGS. 11 and 12. When the door 500 is completely closed, a magnet 520 (in this embodiment, shown as a permanent magnet) is within close proximity to the reed switch apparatus 5 (seen in FIGS. 7-10). This magnet 520, as indicated with references to the several embodiments, forces the reed switch 40 to either close a circuit or open a circuit (depending on whether each of the reed switches 40 is a normally open reed switch or a normally closed reed switch 40).

FIG. 8 is a section view cut across lines 8-8 of FIG. 7, showing the reed switch apparatus 5 in close proximity with the magnet 520. In this view, the reed switches 40 in reed switch apparatus 5 would be active or in a "normal" state as the magnet 520 is within close proximity to reed switch apparatus 5. As the door 500 rolls up and around disc 310 (generally indicated in the direction of arrow C), the magnet 520 moves out of close proximity and the reed switches 40 are no longer activated.

FIG. 9 is a section view cut across lines 9-9 of FIG. 7, showing the details of mounting the reed switch apparatus 5 to the track 410 via the attachment device 20. As can be seen in this figure, the attachment device 20 can be a bracket—allowing the reed switch apparatus 5 to indirectly connect to track 410.

FIG. 10 is a section view cut across lines 10-10 of FIG. 7, showing in a more detailed view the reed switch apparatus 5 in close proximity to the magnet 520. The reed switch apparatus 5 has been mounted to the track 410 via attachment device 20. As can be seen in this figure, several reed switches 40 are housed within the reed switch housing 10. The reed switch housing 10 operates in a similar manner to that described with reference to FIGS. 2 and 3, the switch housing including an outer body 15 and a buffer with a resilient material 25 and a gas-blend 35. This buffer helps protect the reed switches 40 from breaking. While such a buffer is the preferable design, it is to be understood that buffers need not be utilized in every embodiment and that other buffers can be used to the extent foreseeable by one of ordinary skill in the art. The magnet 520 is mounted to door 500 via mounting material 600 such as silicon. As the reed switch apparatus 5 is within close proximity to the magnet 520, the reed switches 40 are activated or in the normal state. When the door 500 moves up and the magnet 520 moves away from the reed switch apparatus 5, each reed switch 40 changes to its non-normal position.

While the reed switch apparatus 5 has been described as utilizing a plurality of reed switches 40 in some embodiments, in other embodiments the reed switch apparatus 5 may include only a single reed switch 40 to activate a device adapted for use with a warehouse storage structure. In such an embodiment, the warehouse storage structure can be one of those known in the art—e.g., including, but not limited to public storage facilities, military storage warehouses, airport hangers/storage, port warehouse storage, rail warehouse storage, manufacture storage warehouses and the like. The device (in which the reed switch 40 in these embodiments communicate with) can include a light, air conditioning system (HVAC), or the like. As an illustrative example and with general reference to the embodiment in FIG. 7 (discussed above), the reed switch apparatus 5 could utilize one reed switch 40. When that reed switch 40 becomes exposed to a magnetic field (e.g., in one of the manners described above), communication between the reed switch 40 and the device can be facilitated (e.g., in one of the manners described above). The facilitation of this communication, in turn, allows the magnetically exposed reed switch 40 to activate the device (e.g., light or air conditioning system) off or on—depending on the reed switch 40 being utilized.

With the use of such an embodiment, electrical costs can be saved. For example, once again with general reference to the embodiment in FIG. 7 (discussed above), a reed switch apparatus 5, mounted to a door track 410, having a single reed switch 40 can activate a light. Upon opening the door 500, the reed switch 40 deactivates (via removal of the magnetic exposure as described above) and communicates with the light to ultimately activate the light (e.g., turn it on). Contrariwise, the closing of the door 500 applies the magnetic exposure to activate the reed switch 40—thus, turning off the light. Thus, as can be seen the activation of the light between the on and off positions can be automatic as the door 500 opens and closes.

Figure 11:
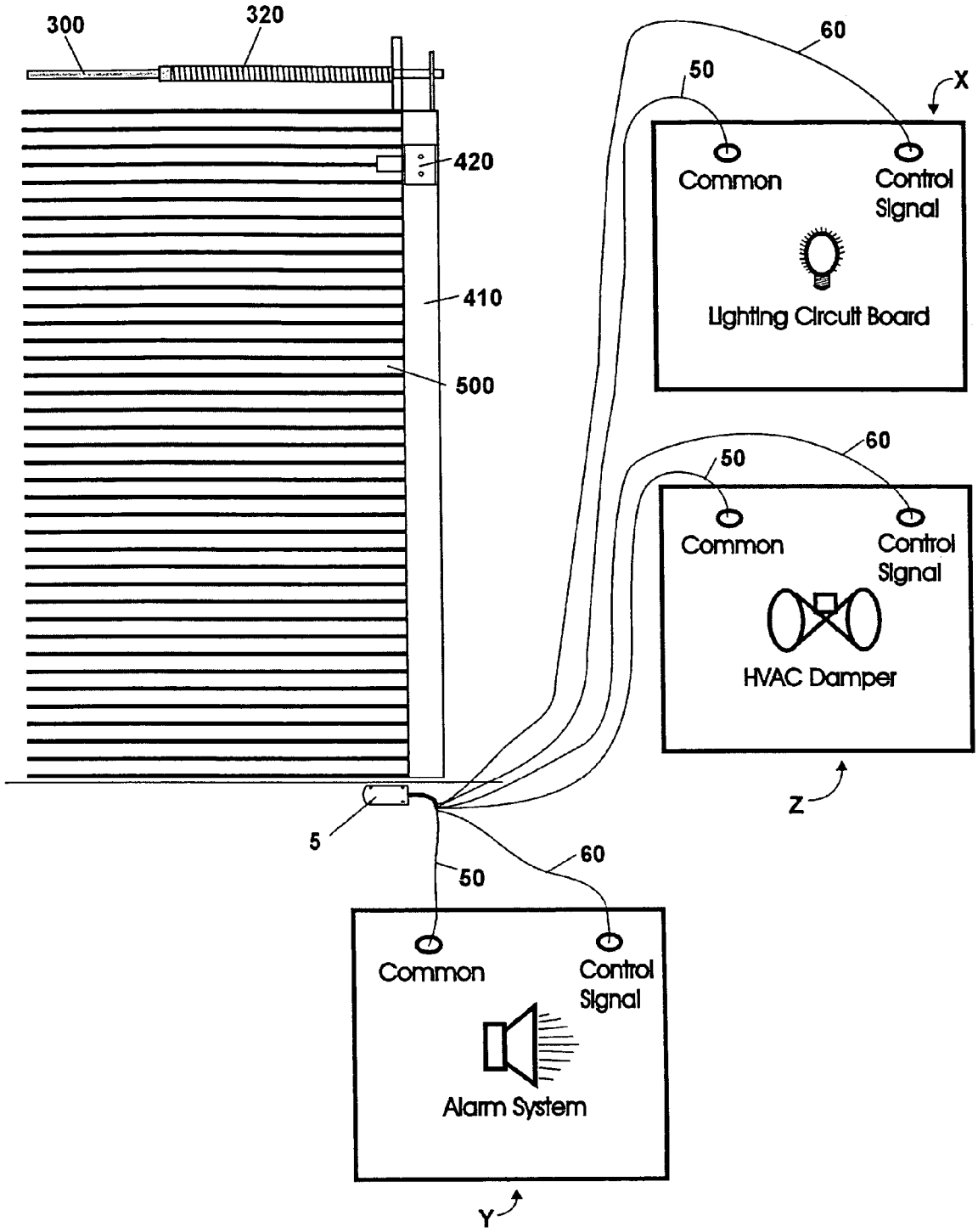
FIG. 11 shows an illustrative embodiment of a use of the reed switch apparatus of FIGS. 7-10 in the communication with multiple devices.

FIG. 11, as indicated above, illustrates the use of a single reed switch apparatus 5 with multiple reed switches 40 (not seen in this embodiment due to perspective) on a roll-up door interfacing with multiple systems or devices. In the embodiment of FIG. 11, reed switch apparatus 5 is mounted on the floor. In the control of multiple devices, the reed switch apparatus 5 in FIG. 11 can, for example, utilize three reed switches 40—one being normally closed and two being normally open. Each of these three reed switches 40 is designed to communicate with only one system or device. In this embodiment, the first normally closed reed switch 40 communicates with an alarm system Y, the first normally open reed switch 40 communicates with an HVAC damper Z, and the second normally open reed switch 40 communicates with a light X. When the door 500 is closed, the magnet 520 (not shown) is in close proximity to reed switch apparatus 5 and hence all three reed switches 40 are in the "normal position". As such, the normally open reed switches 40 have an opened circuit (the light X and the HVAC damper Z) and the normally closed reed switch 40 has a closed circuit (the alarm system Y). When the door 500 is opened, the magnet 520 moves out of close proximity, completing the circuit for the normally opened switch (turning on light X and the HVAC damper Z) and opens the circuit for the normally closed reed switch 40 (alarm system Y does not receive signal sent—indicating the door is open). All devices or systems are signaled simultaneously when one single magnet is moved within close proximity to the reed switch apparatus 5, insuring that all the devices or systems work together seamlessly.

Figure 12:
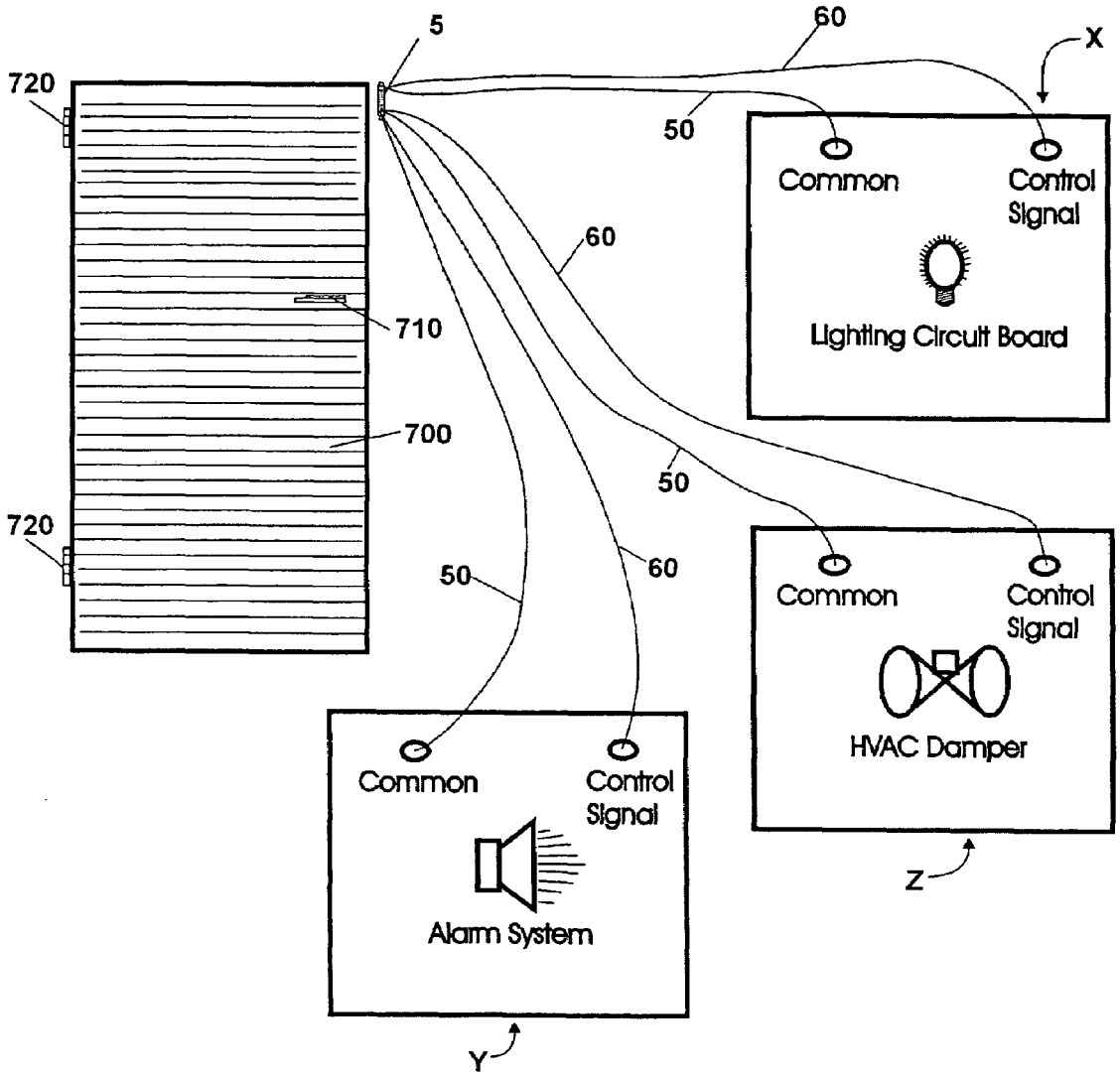
FIG. 12 shows another illustrative embodiment of a use of the reed switch apparatus in the communication with multiple devices.

FIG. 12, in a manner similar to that described with reference to FIG. 11, illustrates the use of a single reed switch apparatus 5 with multiple reed switches 40 (once again, not seen in FIG. 12 due to perspective) interfacing with multiple systems or devices. The devices or systems have been indicated as a lighting circuit board X, an alarm system Y, and an HVAC damper Z. In this embodiment, reed switch apparatus 5 is shown mounted at an adjacent location to a swing door 700—for example, of the type that could be utilized with a storage shed or the like, including standard features such as hinges 720 and a latch 710. The magnet (not shown) can be mounted on an inside portion of the swing door 700 such that when the swing door 700 is closed, the reed switch apparatus 5 is within close proximity to the magnet (not shown).

FIGS. 13 and 14 show another embodiment of the reed switch apparatus 5 being utilized on a door track 610. In this embodiment, the magnet 600 and reed switch apparatus 5 remain in a single location while a door latch 630 interrupts the exposure of the magnetic field from magnet 600 on the reed switches 40 of the reed switch apparatus 5. Both the reed switch apparatus 5 and magnet 600 are mounted to the door track 610 via an attachment device 640 and attachment screws 650. The door track 610 has a hole 620 which is arranged and designed to receive a door latch 630.

As shown in FIG. 14, the door latch 630 extends through the hole 620 between the magnet 600 and reed switch apparatus 5, interrupting the exposure of the magnetic field caused by magnet 600 on reed switch apparatus 5. When the door latch 630 is removed from a location between the magnet 600 and reed switch apparatus 5, the magnetic field from magnet 600 once again exposes the reed switch apparatus 5.

FIG. 13A shows a more detailed view of the reed switch apparatus of FIG. 13. As can be seen in this configuration, the reed switch apparatus 5 need not have a single housing surrounding the reed switches 40. Rather, as can be seen in this embodiment, the reed switch apparatus 5 has three reed switches 40—each with its own housing 65. Therefore, it is to be expressly understood with the embodiments, generally described in FIGS. 1-14 that a single housing 10 (seen, for example, in the embodiment of FIGS. 1-3) can be a multiplicity of housings 65 (seen, for example, in the embodiment of FIGS. 13 and 13A).

As shown and discussed with reference to several of the embodiments described herein, reed switch apparatus 5 can be seen as a control system, arranged and designed to control a plurality of devices or systems. A plurality of the reed switches 40 in a reed switch apparatus 5 lie in very close proximity to one another such that the reed switches 40 can be activated simultaneously via exposure of the reed switch apparatus 5 to a single magnetic field. Thus, the reed switch apparatus 5 advantageously allows a simultaneous establishment of communication with multiple devices. Additionally, with other embodiments, the reed switch apparatus 5 can utilize one or more reed switches 40 to activate one or more devices, adapted for use with a warehouse storage structure—e.g., including, but not limited to lights, air conditioning systems, and the like.

It is to be expressly understood that while the reed switch apparatus 5 has been illustrated in several embodiments with regards to specific uses, it can be utilized in other settings to the extent foreseeable. For example, the reed switch apparatus 5 could be utilized next to a window. As such, the foregoing disclosure and description of the invention are only illustrative and explanatory thereof. Various changes in the details of the illustrated apparatus and construction and method of operation may be made to the extent foreseeable without departing from the spirit of the invention.

I claim:

1. In a warehouse storage structure having a roll up door and a door track, a method of controlling the on/off condition of a high voltage device comprising the steps of:

coupling a reed switch to the door track of the warehouse storage structure;

providing a control module sense circuit having sense terminals receiving a low voltage control signal from the reed switch for controlling the high voltage device, the reed switch having an open state and a closed state;

mounting a permanent magnet member having a constant magnetic field to the roll up door such that the magnetic field is exposed to the reed switch to cause the reed switch to be in one state when the roll up door is in a closed position, and the magnetic field is not exposed to the reed switch when the roll up door is in an open position to cause the reed switch to be in its other state; and controlling the on/off condition of the high voltage device by the control module circuit sense terminals receiving a low voltage control signal when the reed switch is in one state and by the low voltage control signal not being received by the control module circuit sense terminals when the reed switch is in its other state.

2. The method of claim 1, wherein the high voltage device being controlled by the reed switch is a light.

3. The method of claim 2, wherein said step of providing a low voltage control module sense circuit includes connecting a common lead and a control signal lead of the reed switch to the sense terminals on the control module sense circuit.

4. The method of claim 3, wherein said step of controlling the on/off condition of the light results in the light being turned on by opening the roll up door and results in the light being turned off by closing the roll up door.

5. The method of claim 1, wherein said step of controlling the on/off condition of the high voltage device includes automated control by opening and closing the roll up door.

6. The method of claim 1, wherein the control module circuit is a localized circuit at the high voltage device.

7. The method of claim 6, wherein the control module circuit controls a single high voltage device.

8. The method of claim 1, wherein the reed switch is in wireless communication with the low voltage control module sense circuit.

9. In a building structure having a door and a door frame, a method of controlling the on/off condition at a high voltage device comprising the steps of:

coupling a reed switch to the door frame;

providing a low voltage control signal sense circuit communicating with the reed switch for controlling the high voltage device, the reed switch having an open state and a closed state;

mounting a permanent magnet member having a constant magnetic field to the door such that the magnetic field is exposed to the reed switch to cause the reed switch to be in one state when the door is in a closed position, and the magnetic field is not exposed to the reed switch when the door is in an open position to cause the reed switch to be in its other state; and controlling the on/off condition of the high voltage device via a control signal received from the low voltage control signal sense circuit when the reed switch is in one state and by a control signal not being received from the control signal sense circuit when the reed switch is in its other state.

10. The method of claim 9, wherein said step of controlling the ontoff condition of the high voltage device includes automated control by opening and closing the door.

11. A storage structure comprising:

a door cooperatively engaging a door frame;

a first high voltage device installed in the storage structure;

a first reed switch coupled to said door frame, said first reed switch having an open state and a closed state;

a first low voltage control signal circuit including said first reed switch, said first low voltage control signal sense circuit interconnected with said first high voltage device; and a permanent magnet member having a constant magnetic field mounted to said door such that said magnetic field is exposed to said first reed switch to cause said first reed switch to be in one state when said door is in a closed position, and said magnetic field is not exposed to said first reed switch when said door is in an open position to cause said first reed switch to be in its other state, wherein said first low voltage control signal sense circuit has sense terminals facilitating communication between said first reed switch and said first high voltage device, and said state of said first reed switch controls said first high voltage device between an on position and an off position.

12. The storage structure of claim 11, wherein said first reed switch is in wireless communication with said first low voltage control signal sense circuit.

13. The storage structure of claim 11, wherein said first high voltage device is a light.

14. The storage structure of claim 11, wherein said first high voltage device is an air conditioning system damper.

15. The storage structure of claim 11, wherein said on or off position of said first high voltage device is automatically controlled by said open or closed position of said door.

16. The storage structure of claim 11, wherein said on or off position of said first high voltage device is controlled by said state of said first reed switch.

17. The storage structure of claim 11, further comprising a first control module located at said first high voltage device, said first control module including said first low voltage control signal sense circuit.

18. A storage structure comprising:

a door cooperatively engaging a door frame;

a first high voltage device installed in the storage structure;

a second high voltage device installed in the storage structure;

a first reed switch coupled to said door frame, said first reed switch having an open state and a closed state;

a second reed switch coupled to said door frame, said second reed switch having an open state and a closed state;

a first low voltage control signal circuit including said first reed switch, said first low voltage control signal circuit interconnected with said first high voltage device; and a second low voltage control signal circuit including said second reed switch, said second low voltage control signal circuit interconnected with said second high voltage device;

a permanent magnet member having a constant magnetic field mounted to said door such that said magnetic field is exposed to said first reed switch to cause said first reed switch to be in one state when said door is in a closed position, and said magnetic field is not exposed to said first reed switch when said door is in, an open position to cause said first reed switch to be in its other state, said permanent magnet member is such that said magnetic field is exposed to said second reed switch to cause said second reed switch to be in one state when said door is in the closed position, and said magnetic field is not exposed to said second reed switch when said door is in an open position to cause said second reed switch to be in its other state, wherein said first low voltage control signal circuit facilitates communication between said first reed switch and said first high voltage device, and said state of said first reed switch controls said first high voltage device between an on position and an off position.

wherein said second low voltage control signal circuit facilitates communication between said second reed switch and said second high voltage device, and said state of said second reed switch controls said second high voltage device between an on position and an off position, wherein said second reed switch is independent of said first reed switch.

19. The storage structure of claim 18, wherein said first and second high voltage devices are simultaneously but independently controlled.

20. The storage structure of claim 18, wherein said communication of said first reed switch with said first high voltage device is wireless.

21. The storage structure of claim 20, wherein said communication of said second reed switch with said second high voltage device is wireless.

22. The storage structure of claim 18, further comprising a first control module located at said first high voltage device, said first control module including said first low voltage control signal circuit.

23. The storage structure of claim 22, further comprising a second control module located at said second high voltage device, said second control module including said second low voltage control signal circuit.

24. The storage stricture of claim 18, wherein said first high voltage device is a light.

25. The storage structure of claim 18, wherein said first high voltage device is an air conditioning system damper.

26. The method of claim 1, wherein the low voltage control signal from the reed switch for controlling the high voltage device is wireless.

27. The method of claim 9, wherein the reed switch is in wireless communication with the low voltage control signal sense circuit.

28. The storage structure of claim 11, wherein said communication of said first reed switch with said first high voltage device is wireless.

29. A storage structure comprising:

a door cooperatively engaging a door frame;

a reed switch apparatus coupled to said door frame;

a permanent magnet member mounted to said door, said magnet member having a constant magnetic field, said magnetic field being exposed to said reed switch apparatus when said door is in a closed position and being distant from said reed switch apparatus when said door is in an open position;

a high voltage device installed in the storage structure;

a first low voltage control signal circuit interconnected with said high voltage device, said first low voltage control signal circuit facilitating communication between said reed switch apparatus and said first high voltage device;

a door alarm system; and a second low voltage control signal circuit interconnected with said door alarm system, said second low voltage control signal circuit facilitating communication between said reed switch apparatus and said door alarm system, wherein said reed switch apparatus has a normally closed state for controlling said door alarm system and a normally open state for controlling said high voltage device, the state of said reed switch apparatus dependent on whether said magnetic field is exposed or not exposed to said reed switch apparatus.

30. The storage structure of claim 29, wherein said communication of said reed switch apparatus with said high voltage device is wireless.

31. The storage structure of claim 29, wherein said communication of said reed switch apparatus with said door alarm system is wireless.

32. The storage structure of claim 30, wherein said communication of said reed switch apparatus with said door alarm system is wireless.

* * * * *